US007858542B2

(12) United States Patent
Mio et al.

(10) Patent No.: US 7,858,542 B2
(45) Date of Patent: Dec. 28, 2010

(54) FLAME-RETARDANT MATTRESS

(75) Inventors: Wataru Mio, Kobe (JP); Susumu Iwade, Osaka (JP); Yoshitomo Matsumoto, Takasago (JP); Masahiko Mihoichi, Kobe (JP); Shigeru Maruyama, Takasago (JP)

(73) Assignee: Kaneka Corporation, Osaka (JP)

( * ) Notice: Subject to any disclaimer, the term of this patent is extended or adjusted under 35 U.S.C. 154(b) by 849 days.

(21) Appl. No.: 11/254,771

(22) Filed: Oct. 21, 2005

(65) Prior Publication Data

US 2006/0090272 A1 May 4, 2006

Related U.S. Application Data

(60) Provisional application No. 60/622,599, filed on Oct. 28, 2004.

(30) Foreign Application Priority Data

Oct. 22, 2004 (JP) ..... 2004-308729

(51) Int. Cl.
*D04B 27/14* (2006.01)
*A61F 13/15* (2006.01)
*B32B 27/32* (2006.01)

(52) U.S. Cl. ..... 442/310; 428/212; 428/213; 428/219; 428/220

(58) Field of Classification Search ..... 442/310; 428/212–213, 219–220
See application file for complete search history.

(56) References Cited

U.S. PATENT DOCUMENTS

| | | | | |
|---|---|---|---|---|
| 4,123,398 | A * | 10/1978 | Unrau et al. | 524/36 |
| 2004/0198125 | A1 * | 10/2004 | Mater et al. | 442/394 |
| 2004/0219852 | A1 * | 11/2004 | Eichhorn et al. | 442/301 |
| 2006/0234592 | A1 * | 10/2006 | Mio et al. | 442/414 |

FOREIGN PATENT DOCUMENTS

| | | | |
|---|---|---|---|
| JP | 9-217256 | A | 8/1997 |
| JP | 410140478 | A * | 5/1998 |
| JP | 2001-329461 | A | 11/2001 |
| JP | 2003-201642 | A | 7/2003 |

* cited by examiner

*Primary Examiner*—Lynda Salvatore
(74) *Attorney, Agent, or Firm*—Hamre, Schumann, Mueller & Larson, P.C.

(57) ABSTRACT

There is provided a flame-retardant knit fabric which can exhibit texture and comfort inherent to materials such as cotton and urethane foam used for upholstered furniture such as a mattress and chair and bedding products such as a pillow, mattress pad and bedding, the flame-retardant knit fabric which can provide these products with high flame retardance. The internal structure of a mattress is covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the while fabric.

29 Claims, No Drawings

FLAME-RETARDANT MATTRESS

This application claims priority of Japanese Patent Application No. 2004-308729, filed on Oct. 22, 2004 and benefit of U.S. Provisional Application No. 60/622,599, filed on Oct. 28, 2004, in the U.S. Patent and Trademark Office, the disclosures of which are incorporated herein in their entirety by reference.

FIELD OF THE INVENTION

The present invention relates to a flame-retardant mattress provided with flame retardance by a flame-retardant knit fabric having flame blocking ability comprising fibers selected from the group consisting of (A) a halogen-containing fiber, (B) a cellulosic fiber, (C) a flame-retardant cellulosic fiber and (D) a polyester fiber.

DESCRIPTION OF THE RELATED ART

For the prevention of fire, materials used for furniture, bedding, etc. in a house are desirably imparted with flame retardance. Since easily flammable materials such as cotton and urethane foam are used in furniture and bedding for the sake of comfort at use, it is important to prevent the easily flammable materials from igniting for a long time. In addition, the flameproofing material should not impair the comfort or designability of the furniture and bedding.

In the past, various flame-retardant fibers and fireproofing agents have been studied, but there have not yet appeared those fully satisfying this high flame retardance and the requirements as materials of furniture and bedding.

For example, there was a technique, so-called post-processed fireproofing, in which a fireproofing agent is applied on a textile such as a cotton cloth. This technique, however, involves problems such as variation in flame proofing performance due to evenness of adhesion of the fireproofing agent, and impaired feeling and comfort resulted from hardening of the fabric.

In addition, in the case where polyester as a general material is used as a main material, it melts and burns to make holes and the structure cannot be maintained when forcibly combusted, since polyester cannot be a carbonized ingredient, and the fireproof ability to prevent cotton and urethane foam used for the above-mentioned bedding and furniture from ignition was completely insufficient.

In the meantime, a fabric made of a heat-resistant fiber is excellent in flame retardance. It is, however, very expensive and has problems such as workability at fiber-opening as well as poor hygroscopicity and feeling, and a problem that due to poor dyeability it is difficult to obtain highly designable colored pattern.

As a material which improves these drawbacks of materials of furniture and bedding and has excellent texture, hygroscopicity and feeling demanded as general characteristic, and has stable flame retardance, there have been proposed an interior design textile (Patent reference 1 of Japanese Patent Publication No. 05-106132) and a textile for bedding (Patent reference 2 of Japanese Patent Publication No. 05-093330) by flame-retardant fiber composite combining a highly flame-retardant halogen-containing fiber to which a large amount of a flame retardant is added and another fiber which is not made flame-retardant, but there is room for improvement technically. There have been also proposed a flame-retardant nonwoven bulky fabric comprising an essentially flame-retardant fiber and a halogen-containing fiber (Patent reference 3 of WO 03/023108), a flame-retardant nonwoven fabric consisting of a halogen-containing polyacrylonitrile fiber and a fiber supporting the fabric when it is burned (Patent reference 4 of US2004/0062912A1), a flame-retardant nonwoven fabric consisting of a flame-retardant rayon fiber and a flame-retardant acrylic fiber or a flame-retardant melamine fiber (Patent reference 5 of US2004/0097156A1). All of these are, however, techniques using nonwoven fabrics which lack in softness in the touch and elasticity of a knit fabric and cannot exhibit the texture and comfort inherent to such materials as cotton and urethane foam used for bedding and furniture, and therefore they are techniques poor in comfort.

SUMMARY OF THE INVENTION

The present invention has been made to attain an object which was difficult to be solved with the conventional flame-retardant fiber complex, flame-retardant textiles and nonwoven fabric, i.e., to exhibit texture and comfort inherent to materials such as cotton and urethane foam used for a mattress while providing these products with high flame retardance and to obtain a highly flame-retardant mattress by covering the internal structure of mattress with a knit fabric which can attain the object.

The present inventors have conducted intensive studies to solve the above-mentioned problem, and consequently found that a flame-retardant mattress having flame retardance capable of enduring flame for a long time without impairing comfort such as texture and feeling of a mattress can be obtained by preparing a novel flame-retardant knit fabric comprising at least two fibers selected from the group consisting of a halogen-containing fiber (A), a cellulosic fiber (B), a flame-retardant cellulosic fiber (C) and a polyester fiber (D) and using this as a flame blocking fabric.

That is, the present invention relates to the following:

(1) A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, contains a flame retardant at a ratio of at least 2% by weight based on the whole fabric, the mattress which can prevent fire spreading into internal structure in TB603 Flamability Test of State of California, United States;

(2) The flame-retardant mattress of (1) above, wherein the halogen-containing fiber (A) is modacrylic;

(3) The flame-retardant mattress of (1) above, wherein the cellulosic fiber (B) is at least one fiber selected from the group consisting of cotton, hemp, rayon, polynosic, cupra, acetate and triacetate;

(4) The flame-retardant mattress of (3) above, wherein the cellulosic fiber (B) is a cotton fiber;

(5) The flame-retardant mattress of (1) above, wherein the flame-retardant cellulosic fiber (C) is at least one fiber selected from the group consisting of cotton, hemp, rayon, polynosic, cupra, acetate and triacetate;

(6) The flame-retardant mattress of (5) above, wherein the flame-retardant cellulosic fiber (C) is a rayon fiber containing a flame retardant selected from silicic acid and aluminum silicate at 20 to 50% by weight;

(7) The flame-retardant mattress according to (5) above, wherein the flame-retardant cellulosic fiber (C) is a fiber in which a flame retardant selected from the group consisting of phosphoric ester compounds, halogen-containing phosphoric ester compounds, condensed phosphoric ester compounds, polyphosphate compounds, red phosphorus, amine compounds, boric acid, halogen compounds, bromides, urea-formaldehyde compounds, phosphate-urea compounds and ammonium sulfate is added to the cellulosic fiber (B) in an amount of 6 to 25% by weight;

(8) The flame-retardant mattress of any of (1) to (7) above, wherein the knit fabric contains Sb compound at 2 to 20% by weight;

(9) The flame-retardant mattress of any of (1) to (4) above or (8) above, wherein the knit fabric comprises the halogen-containing fiber (A) and the cellulosic fiber (B) and/or the polyester fiber (D);

(10) The flame-retardant mattress of (9) above comprising 20 to 65% by weight of the halogen-containing fiber (A), 35 to 80% by weight of the cellulosic fiber (B) and 0 to 30% by weight of the polyester fiber (D);

(11) The flame-retardant mattress of any of (1) above or (5) to (8) above, wherein the knit fabric comprises the halogen-containing fiber (A) and the flame-retardant cellulosic fiber (C) and/or the polyester fiber (D);

(12) The flame-retardant mattress of (11) above, wherein the knit fabric comprises 20 to 80% by weight of the halogen-containing fiber (A), 20 to 80% by weight of the flame-retardant cellulosic fiber (C) and 0 to 30% by weight of the polyester fiber (D);

(13) The flame-retardant mattress of any of (1) above or (3) to (8) above, wherein the knit fabric comprises the cellulosic fiber (B) and the flame-retardant cellulosic fiber (C) and/or the polyester fiber (D);

(14) The flame-retardant mattress of (13) above, wherein the knit fabric comprises 35 to 80% by weight of the cellulosic fiber (B), 20 to 65% by weight of the flame-retardant cellulosic fiber (C) and 0 to 30% by weight of the polyester fiber (D); and

(15) The flame-retardant mattress of any of (1) to (14) above, wherein the internal structure of the mattress is covered with a flame-retardant knit fabric, and the outermost covering is a piled flame-retardant knit fabric.

The flame-retardant mattress of the present invention is made highly flame-retardant by covering the internal structure of a mattress with a flame-retardant knit fabric while exhibiting texture and comfort inherent to materials such as cotton and urethane foam used for a mattress.

DETAILED DESCRIPTION OF THE PREFERRED EMBODIMENTS

The flame-retardant mattress of the present invention relates to a flame-retardant mattress in which the internal structure is covered with a flame-retardant knit fabric.

Examples of mattress includes a pocket coil mattress in which metal coils are used for the inside, a box coil mattress or a mattress in which an insulator prepared by foaming styrene, polyurethane resin, etc. is used for the inside.

Since fire can be prevented from spreading to the structure inside the above-mentioned mattress by allowing the flame-retardant knit fabric used for the present invention to exhibit flame proofing properties, mattresses having excellent texture and feeling simultaneously with flame retardance can be obtained in mattresses having any structure.

As for the use of the flame-retardant knit fabric of the present invention to the mattress, it can be used as a surface fabric the form of a knit fabric or a pile knit fabric or the knit fabric can be placed between the surface cloth and the internal structure, for example, urethane foam or filling cotton. When it is used as a surface fabric, the flame-retardant knit fabric of the present invention can be used in place of the conventional surface cloth. When it is used by inserting the flame-retardant knit fabric between the surface cloth and the internal structure, it can be inserted in a manner of overlapping two surface cloths or the internal structure may be covered with the flame-retardant knit fabric of the present invention. When it is inserted between the surface cloth and the internal structure as a flame blocking barrier fabric, the whole internal structure is covered with it by placing the flame-retardant knit fabric of the present invention on the outside of the internal structure necessarily at least at the sites where the internal structure contacts with the surface cloth and spreading a cloth thereon.

Moreover, feeling of a low rebounding urethane foam can be exhibited more efficiently in a mattress which uses a low rebounding urethane, particularly in the mattress which comprises a low rebounding urethane foam without combining with the other structure, by using a pile knit fabric which comprises the flame-retardant knit fabric of the present invention as a surface fabric.

The flame-retardant knit fabric of the present invention comprises at least two kinds of fibers selected from the group consisting of a halogen-containing fiber (A), a cellulosic fiber (B), a flame-retardant cellulosic fiber (C) and a polyester fiber (D) and examples of method of making with at least two kinds of fibers include mixed fluffing, mixed spinning, interlaced knitting and overlapping of knit fabrics, although the method is not limited to these.

The flame-retardant knit fabric which can be used for the present invention is suitably used as a flame blocking barrier knit fabric. The flame blocking barrier as used herein means that when the flame-retardant knit fabric is exposed to flame, the flame-retardant knit fabric is carbonized while maintaining the shape of the fibers and blocks the flame thereby preventing the flame spreading to the opposite side. Specifically, by placing the flame-retardant knit fabric of the present invention between the surface cloth of the mattress and urethane foam, filling cotton etc. which serves as the internal structure, ignition of flame in the internal structure can be prevented in case of a fire, and damage can be kept to the minimum. Since the knit fabric is not a woven cloth woven with warp and woof but a knitted web having stretching margin vertically and horizontally and it does not have a large thickness like a nonwoven fabric, texture and comfort inherent to material of cotton and urethane foam used for a mattress can be sufficiently exhibited. In addition, when a carbonized film is formed when burnt, the fibers generally show contraction action and carbonized film deprived of suppleness tends to produce cracks. The knit fabric, however, has stretching margin by which it can expand and contract vertically and horizontally and therefore it is possible to obtain a very good carbonized film which does not produce cracks. The knitting method of the flame-retardant knit fabric is not particularly limited and either of vertical knitting and horizontal knitting can be adopted and there is no particularly restriction on the shaped of the knit fabric and a pile knit fabric having a raised surface may be used.

The flame-retardant knit fabric of the present invention may be used singularly and two or more sheets may be overlapped for use. The knit fabric, formed by overlapping, may comprise at least two fibers selected from the group consisting of (A) a halogen-containing fiber, (B) a cellulosic fiber, (C) a flame-retardant cellulosic fiber and (D) a polyester fiber, have a weight per unit area of at least 140 g/m$^2$ and a thickness of at least 0.5 mm, and contain a flame retardant at least 2% by weight based on the whole fabric, which is contained in or adhered to the halogen-containing fiber (A) and the flame-retardant cellulosic fiber (C).

The flame-retardant knit fabric of the present invention may contain an antistatic agent, a heat coloring inhibitor, a light resistance improver, a whiteness improver, a matting inhibitor and the like if needed.

The flame-retardant knit fabric of the present invention obtained in this way has desired flame retardance and has characteristics excellent in texture, feeling, hygroscopicity, designability and the like.

When a mattress is manufactured using the flame-retardant knit fabric of the present invention, a mattress which has excellent properties which the flame-retardant knit fabric of the present invention has, i.e., excellent flame retardance, and excellen properties such as texture, feeling, hygroscopicity and designability can be obtained.

The flame-retardant knit fabric of the present invention is a knit fabric comprising at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant and an additive contained in or adhered to the halogen-containing fiber (A) and/or the flame-retardant cellulosic fiber (C) in the whole knit fabric at least 2% by weight.

The halogen-containing fiber (A) used for the present invention is an ingredient used for improving flame retardance of the flame-retardant knit fabric, and it is an ingredient which has an effect of helping to self-extinguish the flame on the surface by generating oxygen deficient gas when burnt. Examples of the halogen-containing fiber (A) used for the present invention include homopolymers of halogen-containing monomers such as vinyl chloride and vinylidene chloride, copolymers thereof, and copolymers thereof with a monomer copolymerizable with these halogen-containing monomers such as acrylonitrile, styrene, vinyl acetate, acrylic acid ester, or graft polymers in which the halogen-containing fiber (A) is grafted to PVA polymer etc. but they are not limited to these. Among these halogen-containing fibers (A), it is preferable to use modacrylic fiber which comprises a copolymer of a halogen-containing monomer and acrylonitrile from the point of imparting the flame-retardant knit fabric excellent texture, feeling, and designability along with flame retardance.

It is preferable that a flame retardant is added to the above-mentioned modacrylic fiber in order to enhance the flame retardance of the flame-retardant knit fabric and specific examples of the flame retardant include antimony compounds such as antimony trioxide, antimony pentoxide, antimonic acid, and antimony oxychloride, Sn compounds such as stannic oxide, metastannic acid, stannous oxyhalide, stannic oxyhalide, stannous hydroxide and tin tetrachloride, Zn compounds such as zinc, zinc oxide, zinc borate and zinc carbonate, Mg compounds such as magnesium oxide and magnesium hydroxide, Mo compounds such as molybdenum oxide, Ti compounds such as titanium oxide and barium titanate, N compounds such as melamine sulfate and guanidine sulfamate, P compounds such as polyammonium phosphate and dibutylaminophosphate, Al compounds such as aluminium hydroxide, alminum sulfate and aluminum silicate, Zr compounds such as zirconium dioxide, silicon compounds such as silicate and glass, natural or synthetic mineral compounds such as kaolin, zeolite, montmorillonite, talc, perlite, bentonite, vermiculite, diatomite and graphite, and halogen compounds such as chlorinated paraffine, hexabromobenzene and hexabromocyclododecane. Furthermore, composite compounds such as magnesium stannate, zinc stannate and zirconium stannate may be also used. These may be used singularly or two or more kinds of them may be combined. Among these, antimony compounds are preferable since they react with halogen atoms released from the modacrylic fiber when burnt, generate antimony halide and exhibit very high flame retardance. The antimony compound is added in a modacrylic fiber to the whole flame-retardant knit fabric in an amount of at least 2% by weight so that the antimony compound added in a modacrylic fiber keep flame retardance of the flame-retardant knit fabric and to the whole flame-retardant knit fabric in an amount of at most 20% by weight from a viewpoint of not impairing texture and strength of the flame-retardant knit fabric. Examples of modacrylic fiber include Kanecaron manufactured by Kaneka Corp. and SEF manufactured by Solutia Corp., but they are not limited thereto.

The cellulosic fiber (B) used for the present invention is an ingredient which keeps the strength of the flame-retardant knit fabric and imparts the fabric with comfort such as excellent texture and hygroscopicity, and it is an ingredient which has an effect of forming a carbonized film when burnt. Examples of the cellulosic fiber (B) include cotton, hemp, rayon, polynosic, cupra, acetate and triacetate, and these may be used singularly or two or more kinds of them may be combined.

The flame-retardant cellulosic fiber (C) is an ingredient which improves flame retardance and keeps the strength of the flame-retardant knit fabric and imparts the fabric with comfort such as excellent texture and hygroscopicity, and it is an ingredient which has an effect of forming a carbonized film when burnt.

As the flame-retardant cellulosic fiber (C) used for the present invention, silicic acid-containing cellulosic fiber in which silicic acid or/and aluminum silicate is contained in a cellulosic fiber as a flame retardant or a flame-retardant cellulosic fiber (C) which is made flame-retardant by post-processing etc. using a flame retardant. Specific examples of the cellulosic fiber which is a substrate of the flame-retardant cellulosic fiber (C) include cotton, hemp, rayon, polynosic, cupra, acetate and triacetate. These may be used singularly or two or more kinds of them may be combined and used.

The above-mentioned silicate-containing cellulosic fiber is a cellulose fiber which contains silicic acid or/and aluminum silicate in 20 to 50% in the fiber as a flame retardant. It has usually a fineness of about 1.7 to 8 dtex, and about 38 to 128 mm of cut length. Specific examples thereof include Visil of Sateri Co. which containes silicic acid in an amount of about 30% in the fiber and Visil AP of Sateri which contains aluminum silicate in an amount of about 33% in the fiber, but they are not limited to these.

Flame retardants used for making the above-mentioned cellulosic fiber flame-retardant by post-processed etc., include phosphoric ester compounds such as triphenyl phosphate, tricresyl phosphate, trixylenyl phosphate, trimethyl phosphate, triethyl phosphate, cresylphenyl phosphate, xylenyldiphenyl phosphate, resorcinol bis(diphenyl phosphate), 2-ethylhexyldiphenyl phosphate, dimethylmethyl phosphate, triallyl phosphate (Reophos), aromatic phosphoric esters, phosphonocarboxylic amide derivatives, tetrakis hydroxymethylphosphonium derivatives, N-methyloldimethylphosphonopropionamide, halogen-containing phosphoric ester compounds such as tris(chloroethyl) phosphate, tris-dichloropropyl phosphate, tris-β-chloropropyl phosphate, chloroalkyl phosphate, tris(tribromoneopentyl) phosphate, diethyl-N,N-bis(2-hydroxyethyl)aminomethyl phosphate, tris(2,6-dimethylphenyl) phosphate, condensed phosphoric ester compounds such as aromatic condensed phosphoric ester and halogen-containing condensed phosphoric ester, polyphosphate compounds such as polyphosphoric acid ammonium amide and polychlorophosphonate, polyphosphoric ester compounds such as a polyphosphoric acid carbamate, red phosphorus, amine compounds, boric acid, halogen compound, bromides, urea-formaldehyde compound, phosphate-urea compounds such as phosphorus-containing aminoplasto, ammonium sulfate, guanidine condensed product, etc., and these may be used singly, or two or more kinds of them may be combined for use. These flame-retardant agents are added to the cellulosic fiber, and the addition amount may be at least 2% by weight to the whole flame-retardant knit fabric in order to maintain the flame retardance. It is preferable to add more flame-retardant agent to the flame-retardant knit fabric from a viewpoint of flame retardance and an amount of at most 20% by weight is added to the whole flame-retardant knit fabric from a viewpoint of not impairing texture of the flame-retardant knit fabric.

The polyester fiber (D) used for the present invention is an ingredient which imparts the flame-retardant knit fabric of the present invention with excellent texture, feeling, designability, product strength, washing resistance and durability and at the same time, the polyester fiber (D) itself is an inflammable fiber but melted when burnt and has an effect of improving a formed carbonized film by covering the carbonized film with the melted substance.

The flame-retardant knit fabric of the present invention has a weight per unit area of at least 140 g/m$^2$, preferably at least 170 g/m$^2$ and a thickness of at least 0.5 mm, preferably at least 0.8 mm from viewpoint of flame retardance. When the weight per unit area is less than 140 g/m$^2$, the density of the carbonized film formed when burnt is sparse and the performance to prevent cotton and urethane foam used for upholstered furniture such as mattress and chair and bedding products such as pillow, mattress pad and bedding from ignition becomes insufficient. When the thickness is less than 0.5 mm, the thickness of the carbonized film formed when burnt becomes thin, and the performance to prevent cotton and urethane foam used for upholstered furniture such as mattress and chair and bedding products such as pillow, mattress pad and bedding from igniting becomes insufficient.

The content of a flame-retardant agent in the whole flame-retardant knit fabric of the present invention is at least 2% by weight, preferably at least 3% by weight. When the content of a flame-retardant agent in the whole flame-retardant knit fabric is less than 2% by weight, self-extinguishing capability when burnt is insufficient, and the performance to prevent cotton and urethane foam used for upholstered furniture such as mattress and chair and bedding products such as pillow, mattress pad and bedding from igniting becomes insufficient. The more the content of flame-retardant agent in the whole flame-retardant knit fabric is, the higher flame retardance is obtained, and the content of flame-retardant agent in the whole flame-retardant knit fabric is preferably at most 35% by weight from a viewpoint of not impairing texture and feeling thereof.

In order to obtain a flame-retardant knit fabric having comfort such as excellent texture and hygroscopicity as well as high self-extinguishing properties in the present invention, the flame-retardant knit fabric comprising the halogen-containing fiber (A) and the cellulosic fiber (B) and/or the polyester fiber (D) of Claim 9 or 10 is obtained. The content ratios of the halogen-containing fiber (A), the cellulosic fiber (B) and the polyester fiber (D) can be determined by comfort such as texture and hygroscopicity, washing resistance, durability, and strength of the flame-retardant knit fabric, degree of formation of the carbonized film, and self-extinguishing rate, and it is preferable that the content of the halogen-containing fiber (A) is 20 to 65% by weight, that of the cellulosic fiber (B) is 35 to 80% by weight and that of polyester fiber (D) is 0 to 30% by weight. When the content of the halogen-containing fiber (A) is less than 20% by weight, the flame retardance of the flame-retardant knit fabric becomes insufficient and when the content of the cellulosic fiber (B) is less than 35% by weight, the capability of forming a carbonized film when burnt becomes insufficient and comfort such as texture and hygroscopicity cannot be sufficiently obtained, thus being unfavorable. Although improvement in washing resistance and durability can be expected by adding polyester fiber (D), if the content of the polyester fiber (D) exceeds 30% by weight, the content ratio of the polyester fiber (D) in the flame-retardant knit fabric becomes too large, and flame retardance becomes inferior, thus being unfavorable.

In order to obtain a flame-retardant knit fabric having comfort such as excellent texture and hygroscopicity as well as high flame retardance in the present invention, the flame-retardant knit fabric comprising the halogen-containing fiber (A) and the flame-retardant cellulosic fiber (C) and/or polyester fiber (D) of Claim 11 or 12 is obtained. Although the content ratios of the halogen-containing fiber (A), the flame-retardant cellulosic fiber (C) and the polyester fiber (D) can be determined by comfort such as texture and hygroscopicity, washing resistance, durability, and strength of the flame-retardant knit fabric, degree of formation of the carbonized film, and self-extinguishing rate, it is preferable that the content of the halogen-containing fiber (A) is 20 to 80% by weight and that of the flame-retardant cellulosic fiber (C) is 20 to 80% by weight. When the content of the halogen-containing fiber (A) is less than 20% by weight, self-extinguishing rate of the flame-retardant knit fabric does not sufficiently increase, and when the flame-retardant cellulosic fiber (C) is less than 20% by weight, the capability of forming a carbonized film when burnt becomes insufficient and, further, comfort such as texture and hygroscopicity cannot be sufficiently obtained, which is not preferable. Although improvement in washing resistance and durability can be expected by adding polyester fiber (D), if the content of the polyester fiber (D) exceeds 30% by weight, the content ratio of the polyester fiber (D) in the flame-retardant knit fabric becomes too large, and flame retardance becomes inferior, thus being not preferable.

In order to obtain a flame-retardant knit fabric having higher comfort such as excellent texture and hygroscopicity as well as higher flame retardance in the present invention, the flame-retardant knit fabric comprising the flame-retardant cellulosic fiber (C) and the cellulosic fiber (B) and/or the polyester fiber (D) of Claim 13 or 14 is obtained. Although the content ratios of flame-retardant cellulosic fiber (C), the cellulosic fiber (B) and the polyester fiber (D) can be determined by comfort such as texture and hygroscopicity, washing resistance, durability, and degree of flame retardance, it is preferable that the content of the flame-retardant cellulosic fiber (C) is 20 to 65% by weight and that of the cellulosic fiber (B) is 35 to 80% by weight. When the content of the flame-retardant cellulosic fiber (C) is less than 20% by weight, flame retardance of the flame-retardant knit fabric becomes insufficient and when the content of the flame-retardant cellulosic fiber (C) exceeds 80% by weight, feeling becomes inferior due to the flame-retardant treatment and comfort such as texture and hygroscopicity becomes insufficient as compared with cellulose made not flame-retardant, thus being not preferable. Although improvement in washing resistance and durability can be expected by adding polyester fiber (D), if the content of the polyester fiber (D) exceeds 30% by weight, ratio of the polyester fiber (D) in the flame-retardant knit fabric becomes large, and flame retardance becomes inferior, thus being not preferable.

The flame-retardant knit fabric of the present invention may be used singularly and two or more sheets may be overlapped to be used, and a knit fabric comprising at least two kinds of fibers selected from the group consisting of (A) a halogen-containing fiber, (B) a cellulosic fiber, (C) a flame-retardant cellulosic fiber and (D) a polyester fiber, and having a weight per unit area of at least 140 g/m$^2$ and a thickness of at least 0.5 mm with the content of flame retardant contained in or adhered to the halogen-containing fiber (A) and the flame-retardant cellulosic fiber (C) in the knit fabric on the whole being at least 2% by weight may be formed by overlapping.

That is, the flame-retardant knit fabric enables to obtain a flame-retardant mattress having flame retardance capable of enduring flame for a long time without impairing comfort such as texture and feeling of a mattress.

EXAMPLES

Hereinafter the present invention is explained in detail by way of Examples, but is not limited to thereto.

Preparation of Simple Mattress for Flame Retardance Evaluation

Flame retardance of a flame-retardant mattress was evaluated by preparing a simple mattress. When a knit fabric was used as a flame-blocking sheet, urethane foam was used as the internal structure of the mattress and the surroundings thereof was covered completely by the knit fabric and open sites were completely closed using cotton thread. Furthermore, the knit fabric was covered with a two-layer structure of a nonwoven fabric prepared by needle punch method comprising a polyester fiber having a weight per unit area of 200 g/m$^2$ and a polyester woven cloth (weight per unit area 120 g/m$^2$) as a surface cloth overlapped thereon was quilted using cotton thread and open sites were completely closed using cotton thread to prepare a simple mattress. As the urethane foam, polyurethane foam (Type 360S available from Toyo Tire & Rubber CO., LTD.) of 30 cm (length)×45 cm (width)×7.5 cm (thickness) and density of 22 kg/m$^3$ was used.

When a nonwoven fabric was used as a flame-blocking sheet, urethane foam was used as the internal structure of the mattress and a sample was prepared by the following method. After the fibers mixed at a predetermined ratios were open-fibered with a card, and the urethane foam was covered with a three-layer structure of a nonwoven fabric prepared by needle punch method and having a weight per unit area of 200 g/m$^2$ (nonwoven fabric for burning Test) as the third layer, a nonwoven fabric prepared by needle punch method comprising a polyester fiber having a weight per unit area of 200 g/m$^2$ as the second layer and a woven fabric of a polyester fiber having a weight per unit area of 120 g/m$^2$ as the first layer overlapped with each other was quilted using cotton thread and open sites were completely closed using cotton thread to prepare a simple mattress. As the urethane foam, polyurethane foam (Type 360S by Toyo Tire & Rubber CO., LTD.) of 30 cm (length)×45 cm (width)×7.5 cm (thickness) and density of 22 kg/m$^3$ was used.

Evaluation Method of Flame Retardance

Flame retardance of the flame-retardant mattress in EXAMPLES was evaluated using the simple mattress prepared in accordance with the procedure of preparation of the simple mattress for flame retardance evaluation, and evaluation was carried out based on the burning test method of Technical Bulletin 603 (hereinafter, TB 603) of the bed in California, U.S. The TB603 Flamability Test method of California, U.S is explained briefly. A T-letter type burner is perpendicularly set on the site 42 mm from the side of the bed and another T-letter type burner horizontally on the site 39 mm above the top surface of the bed. As combustion gas, propane gas is used with gas pressure of 101 KPa and the gas flow of 12.9 L/min on the top surface while 6.6 L/min on the side surface. The flame is allowed to reach on the top surface for 70 seconds and on the side surface for 50 seconds, and observation time in total is for 30 minutes. If the amount of maximum heat discharge is less than 200 Kw and the first amount of accumulated heat discharge for 10 minutes is less than 25 MJ, the product passes the test.

The flame retardance test of a flame-retardant mattress was performed in accordance with the above-mentioned burning Test method, and as for the evaluation method of flame-retardant level, one in which no flame remained within 30 seconds after the flame was contacted was evaluated as excellent, one in which remaining flame or fire disappears in at least 10 seconds as good, one in which the urethane foam ignited as bad, and those in which ignition on the urethane foam was not observed were assumed to pass the test.

Preparation Example 1 of Halogen-Containing Fiber (A)

A copolymer obtained by copolymerization of 52 parts by weight of acrylonitrile, 46.8 parts by weight of vinylidene chloride and 1.2 parts by weight of styrene sodium sulfonate was dissolved in acetone to form a 30% by weight solution. At this time, 10 parts by weight of antimony trioxide was added to 100 weight parts of the copolymer to prepare a spinning solution. The obtained spinning solution was extruded into a 38% by weight aqueous solution of acetone at 25° C. through a nozzle having 33000 holes and a hole diameter of 0.07 mm and the formed filament was washed with water and thereafter was dried at 120° C. for 8 minutes. The filament was heat-drawn to increase the length of the filament three times at 150° C. and then heat-treated at 175° C. for 30 minutes to obtain a halogen-containing fiber of a fineness of 2 dtex. Finishing oil agent for spinning (available from Takemoto Oil & Fat Co., Ltd.) was supplied to the obtained halogen-containing flame-retardant fiber, climp was attached, and the fiber was cut into a length of 51 mm.

Preparation Example 2 of Halogen-Containing Fiber (A)

A halogen-containing fiber (A) was prepared by the same method as in Preparation Example 1 except that 17 parts by weight of antimony trioxide was added to prepare a spinning solution.

Preparation Example 3 of Halogen-Containing Fiber (A)

A halogen-containing fiber (A) was prepared by the same method as in Preparation Example 1 except that 26 parts by weight of antimony trioxide was added to prepare a spinning solution.

Preparation Example 1 of Flame-Retardant Rayon Fiber (C)

A spun yarn of metric count of No. 34 was manufactured from a rayon (fiber fineness of 1.5 dtex, 38 mm of cut length) fiber and ammonium polyphosphate (available from Suzuhiro Chemical Co., Ltd., FCP-730) was added to the rayon fiber in an amount of 20% by weight as a flame retardant.

Preparation Example 1 of Knit Fabric

After fibers were mixed at the ratios shown in Table 1 and open-fibered with a card, a nonwoven fabric was prepared by needle punch method. The ratios of the fibers used and the weight per unit area of the nonwoven fabrics are shown in Table 1.

TABLE 1

| | Mixing ratio of fibers in the fabric (wt %) | | | Structure of the fabric | | | Burning Test | | | |
|---|---|---|---|---|---|---|---|---|---|---|
| Ex. No. | Halogen-containing fiber | Cotton fiber | Polyester fiber | A Flame-retardant agent in the fabric (wt %) | B Weight per unit area ($g/m^2$) | C Thickness (mm) | Flame remaining time (sec) | Evaluation | State of carbonated film | General Evaluation |
| Ex. 1 | 35 | 65 | 0 | 3.1 | 280 | 1.0 | 8 | Excellent | Good | Pass |
| Ex. 2 | 55 | 45 | 0 | 10.8 | 145 | 0.6 | 3 | Excellent | Good | Pass |
| Ex. 3 | 43 | 57 | 0 | 6.2 | 145 | 0.6 | 5 | Excellent | Good | Pass |
| Ex. 4 | 28 | 46 | 26 | 2.5 | 313 | 1.4 | 8 | Excellent | Good | Pass |
| Com. Ex. 1 | 35 | 65 | 0 | 3.1 | 278 | 12 | Compulsorily extinguished | Bad | Opening | Not pass |
| Com. Ex. 2 | 55 | 45 | 0 | 10.8 | 270 | 13 | Compulsorily extinguished | Bad | Opening | Not pass |
| Com. Ex. 3 | 28 | 46 | 26 | 2.5 | 340 | 15 | Compulsorily extinguished | Bad | Opening | Not pass |

A spun yarn of metric count of No. 34 was obtained by mixed spinning of 35% by weight of a halogen containing fiber (A) prepared in Preparation Example 1 of halogen containing fiber (A) and 65% by weight of a cotton fiber. A knit fabric having a weight per unit area of 280 $g/m^2$ containing 35% by weight of a halogen-containing fiber (A) and 65% by weight of a cotton fiber was prepared from this spun yarn using a commonly known circular knitting machine.

Preparation Example 2 of Knit Fabric

A spun yarn of metric count of No. 34 was obtained by mixed spinning of 55% by weight of a halogen containing fiber (A) prepared in Preparation Example 2 of halogen containing fiber (A) and 45% by weight of a cotton fiber. A knit fabric having a weight per unit area of 145 $g/m^2$ containing 55% by weight of a halogen-containing fiber (A) and 45% by weight of a cotton fiber was prepared from this spun yarn using a commonly known circular knitting machine.

Preparation Example 3 of Knit Fabric

A spun yarn of metric count of No. 34 was obtained by mixed spinning of 43% by weight of a halogen containing fiber (A) prepared in Preparation Example 3 of halogen containing fiber (A) and 43% by weight of a cotton fiber. A knit fabric having a weight per unit area of 145 $g/m^2$ containing 43% by weight of a halogen-containing fiber (A) and 57% by weight of a cotton fiber was prepared from this spun yarn using a commonly known circular knitting machine.

Preparation Example 4 of Knit Fabric

A spun yarn of metric count of 34 was obtained by mixed spinning of 35% by weight of a halogen containing fiber (A) prepared in Preparation Example 1 of halogen containing fiber (A) and 65% by weight of a cotton fiber. This spun yarn was used for pile, and a spun yarn of metric count of No. 34 comprising a polyester fiber (D) was used for ground yarn and a pile unit was composed using a commonly known sinker pile knitting machine. As a finishing procedure, loops at pile portion were cut by shirring and a pile knit fabric having a weight per unit area of 313 $g/m^2$ containing 28% by weight of a halogen-containing fiber (A), 45% by weight of a cotton fiber and 26% by weight of a polyester fiber was prepared.

Preparation Example 5 of Knit Fabric

A spun yarn of metric count of 34 was obtained by mixed spinning of 20% by weight of a halogen containing fiber (A) prepared in Preparation Example 1 of halogen containing fiber (A) and 80% by weight of a silicic acid-containing rayon fiber (C) (Visil) (fineness of 1.7 dtex, cut length of 40 mm) manufactured by Sateri Corp was obtained. A knit fabric having a weight per unit area of 210 $g/m^2$ containing 20% by weight of a halogen-containing fiber (A) and 80% by weight of a silicon-containing rayon fiber was prepared from this spun yarn using a commonly known circular knitting machine.

Preparation Example 6 of Knit Fabric

A spun yarn of metric count of No. 34 was obtained by mixed spinning of 20% by weight of a halogen containing fiber (A) prepared in Preparation Example 1 of halogen containing fiber (A) and 80% by weight of a flame-retardant rayon fiber. A knit fabric having a weight per unit area of 210 $g/m^2$ containing 20% by weight of a halogen-containing fiber (A) and 80% by weight of a flame-retardant rayon fiber was prepared from this spun yarn using a commonly known circular knitting machine.

Preparation Example 7 of Knit Fabric

A spun yarn of metric count of No. 34 was obtained by mixed spinning of 40% by weight of a silicic acid-containing rayon fiber (C) (Visil) (fineness of 1.7 dtex, cut length of 40 mm) manufactured by Sateri Corp and 60% by weight of a cotton fiber (fineness of 1.5 dtex, 38 mm of cut length) was obtained. A knit fabric having a weight per unit area of 210 g/m$^2$ containing 40% by weight of a silicic-containing rayon fiber (C) and 60% by weight of a cotton fiber was prepared from this spun yarn using a commonly known circular knitting machine.

Preparation Example 8 of Knit Fabric

A spun yarn of metric count of 34 was obtained by mixed spinning of 50% by weight of a flame-retardant rayon fiber (C) prepared in Preparation Example 1 of flame-retardant rayon fiber and 50% by weight of a cotton fiber (fineness of 1.5 dtex, 38 mm of cut length). A knit fabric having a weight per unit area of 210 g/m$^2$ containing 50% by weight of a flame-retardant rayon fiber (C) and 50% by weight of a cotton fiber (B) was prepared from this spun yarn using a commonly known circular knitting machine.

Preparation Example 1 of a Nonwoven Fabric for Burning Test

After 35% by weight of a halogen-containing fiber (A) prepared in Preparation Example 1 of halogen-containing fiber (A) and 65% by weight of cotton fiber were mixed and open-fibered with a card, a nonwoven fabric of weight per unit area 278 g/m$^2$ was prepared by a needle punch method.

Preparation Example 2 of a Nonwoven Fabric for Burning Test

After 55% by weight of a halogen-containing fiber (A) prepared in Preparation Example 1 of halogen-containing fiber (A) and 45% by weight of cotton fiber were mixed and open-fibered with a card, a nonwoven fabric of weight per unit area 270 g/m$^2$ was prepared by the needle punch method.

Preparation Example 3 of a Nonwoven Fabric for Burning Test

After 28% by weight of a halogen-containing fiber (A) prepared in Preparation Example 1 of halogen-containing fiber (A), 46% by weight of cotton fiber and 26% by weight of polyester fiber were mixed and open-fibered with a card, a nonwoven fabric of weight per unit area 340 g/m$^2$ was prepared by the needle punch method.

Preparation Example 4 of a Nonwoven Fabric for Burning Test

After 20% by weight of a halogen-containing fiber (A) prepared in Preparation Example 1 of halogen-containing fiber (A) and 80% by weight of a silicic acid-containing rayon fiber (C) (Visil) (fineness of 1.7 dtex, cut length of 40 mm) manufactured by Sateri Corp were mixed and open-fibered with a card, a nonwoven fabric of weight per unit area 202 g/m$^2$ was prepared with the needle punch method.

Preparation Example 5 of a Nonwoven Fabric for Burning Test

After 20% by weight of a halogen-containing fiber (A) prepared in Preparation Example 1 of halogen-containing fiber (A), 80% by weight of a flame-retardant rayon fiber (C) prepared in Preparation Example 1 of flame-retardant rayon fiber were mixed and open-fibered with a card, a nonwoven fabric of weight per unit area 203 g/m$^2$ was prepared by the needle punch method.

Preparation Example 6 of a Nonwoven Fabric for Burning Test

After 40% by weight of Visil (fineness of 1.7 dtex, cut length of 40 mm) manufactured by Sateri Corp and 60% by weight of a cotton fiber were mixed and open-fibered with a card, a nonwoven fabric of weight per unit area 203 g/m$^2$ was prepared by the needle punch method.

Preparation Example 7 of a Nonwoven Fabric for Burning Test

After 50% by weight of a flame-retardant rayon fiber (C) prepared in Preparation Example 1 of flame-retardant rayon fiber and 50% by weight of a cotton fiber were mixed and open-fibered with a card, a nonwoven fabric of weight per unit area 202 g/m$^2$ was prepared with a needle punch method.

Example 1

Preparation 1 of a Simple Mattress

The knit fabric prepared in Preparation Example 1 of knit fabric was used and combined with urethane foam and a simple mattress was prepared by the method of preparation of a simple mattress for flame-retardant evaluation, and flame-retardant evaluation was carried out. The results are shown in Table 1.

Example 2

Preparation 1 of a Simple Mattress

The knit fabric prepared in Preparation Example 2 of knit fabric was used and combined with urethane foam and a simple mattress was prepared by the method of preparation of a simple mattress for flame-retardant evaluation, and flame-retardant evaluation was carried out. The results are shown in Table 1.

Example 3

Preparation 1 of a Simple Mattress

The knit fabric prepared in Preparation Example 3 of knit fabric was used and combined with urethane foam and a simple mattress was prepared by the method of preparation of a simple mattress for flame-retardant evaluation, and flame-retardant evaluation was carried out. The results are shown in Table 1.

Example 4

Preparation 1 of a Simple Mattress

The knit fabric prepared in Preparation Example 4 of knit fabric was used and combined with urethane foam and a simple mattress was prepared by the method of preparation of a simple mattress for flame-retardant evaluation, and flame-retardant evaluation was carried out. The results are shown in Table 1.

Comparative Example 1

Preparation 1 of a Simple Mattress

The non-woven fabric prepared in Preparation Example 1 of nonwoven fabric for the burning test was used and combined with urethane foam and a simple mattress was prepared by the method of preparation of a simple bed for flame-retardant evaluation, and flame-retardant evaluation was carried out. The results are shown in Table 1.

Comparative Example 2

Preparation 1 of a Simple Mattress

The non-woven fabric prepared in Preparation Example 2 of nonwoven fabric for the burning test was used and combined with urethane foam and a simple mattress was prepared by the method of preparation of a simple bed for flame-retardant evaluation, and flame-retardant evaluation was carried out. The results are shown in Table 1.

Comparative Example 3

Preparation 1 of a Simple Mattress

The non-woven fabric prepared in Preparation Example 3 of nonwoven fabric for the burning test was used and combined with urethane foam and a simple mattress was prepared by the method of preparation of a simple bed for flame-retardant evaluation, and flame-retardant evaluation was carried out. The results are shown in Table 1.

As shown in Table 1, flame retardance was good for Examples 1 to 4. On the other hand, since Comparative Examples 1 and 3 did not use knit fabric compared with Examples 1 and 3, the carbonized film was not able to absorb the shrinkage of the fiber by heat and the film was broken, and the urethane foam was ignited. Although the weight per unit area was high in Comparative Example 2 compared with that in Example 2, urethane foam was ignited for the same reason.

Example 5

Preparation 1 of a Simple Mattress

The knit fabric prepared in Preparation Example 5 of knit fabric was used and combined with urethane foam and a simple mattress was prepared by the method of preparation of a simple bed for flame-retardant evaluation, and flame-retardant evaluation was carried out. The results are shown in Table 2.

TABLE 2

| | Mixing ratio of fibers in the fabric (wt %) | | | Structure of the fabric | | | Burning Test | | | |
|---|---|---|---|---|---|---|---|---|---|---|
| Ex. No. | Halogen-containing fiber | Silicic acid-containing rayon fiber | Post-processed rayon fiber | A Flame-retardant agent in the fabric (wt %) | B Weight per unit area ($g/m^2$) | C Thickness (mm) | Flame remaining time (sec) | Evaluation | State of carbonated film | General evaluation |
| Ex. 5 | 20 | 80 | 0 | 25.8 | 210 | 0.8 | 12 | Good | Good | Pass |
| Ex. 6 | 20 | 0 | 80 | 15.1 | 210 | 0.7 | 8 | Excellent | Good | Pass |
| Com. Ex. 4 | 20 | 80 | 0 | 25.8 | 202 | 11 | Compulsorily extinguished | Bad | Opening | Not pass |
| Com. Ex. 5 | 20 | 0 | 80 | 15.1 | 203 | 12 | Compulsorily extinguished | Bad | Opening | Not pass |

Example 6

Preparation 1 of a Simple Mattress

The knit fabric prepared in Preparation Example 6 of knit fabric was used and combined with urethane foam and a simple mattress was prepared by the method of preparation of a simple bed for flame-retardant evaluation, and flame-retardant evaluation was carried out. The results are shown in Table 2.

Comparative Example 4

Preparation 1 of a Simple Mattress

The non-woven fabric prepared in Preparation Example 4 of nonwoven fabric for the burning test was used and combined with urethane foam and a simple mattress was prepared by the method of preparation of a simple bed for flame-retardant evaluation, and flame-retardant evaluation was carried out. The results are shown in Table 2.

Comparative Example 5

Preparation 1 of a Simple Mattress

The non-woven fabric prepared in Preparation Example 5 of nonwoven fabric for the burning test was used and combined with urethane foam and a simple mattress was prepared by the method of preparation of a simple bed for flame-retardant evaluation, and flame-retardant evaluation was carried out. The results are shown in Table 2.

As shown in Table 2, flame retardance was good for Examples 5 and 6. On the other hand, since Comparative Examples 4 and 5 did not use knit fabric compared with Example 5 and 6 and the carbonized film was not able to absorb shrinkage of the fiber by heat and the film was broken, and the urethane foam was ignited.

Example 7

Preparation 1 of a Simple Mattress

The knit fabric prepared in Preparation Example 7 of knit fabric was used and combined with urethane foam and a simple mattress was prepared by the method of preparation of a simple bed for flame-retardant evaluation, and flame-retardant evaluation was carried out. The results are shown in Table 3.

TABLE 3

| | Mixing ratio of fibers in the fabric (wt %) | | | Structure of the fabric | | | Burning Test | | | |
|---|---|---|---|---|---|---|---|---|---|---|
| Ex. No. | Silicic acid-containing rayon fiber | Post-processed rayon fiber | Cotton fiber | A Flame-retardant agent in the fabric (wt %) | B Weight per unit area ($g/m^2$) | C Thickness (mm) | Flame remaining time (sec) | Evaluation | State of carbonated film | General evaluation |
| Ex. 7 | 40 | 0 | 60 | 12 | 210 | 0.8 | 18 | Good | Good | Pass |
| Ex. 8 | 0 | 50 | 50 | 8.4 | 210 | 0.8 | 16 | Good | Good | Pass |
| Com. Ex. 6 | 40 | 0 | 60 | 12 | 203 | 13 | Compulsorily extinguished | Bad | Opening | Not pass |
| Com. Ex. 7 | 0 | 50 | 50 | 8.4 | 202 | 12 | Compulsorily extinguished | Bad | Opening | Not pass |

Example 8

Preparation 1 of a Simple Mattress

The knit fabric prepared in Preparation Example 8 of knit fabric was used and combined with urethane foam and a simple mattress was prepared by the method of preparation of a simple bed for flame-retardant evaluation, and flame-retardant evaluation was carried out. The results are shown in Table 3.

Comparative Example 6

Preparation 1 of a Simple Mattress

The non-woven fabric prepared in Preparation Example 6 of nonwoven fabric for the burning test was used and combined with urethane foam and a simple mattress was prepared by the method of preparation of a simple bed for flame-retardant evaluation, and flame-retardant evaluation was carried out. The results are shown in Table 3.

Comparative Example 7

Preparation 1 of a Simple Mattress

The non-woven fabric prepared in Preparation Example 7 of nonwoven fabric for the burning test was used and combined with urethane foam and a simple mattress was prepared by the method of preparation of a simple bed for flame-retardant evaluation, and flame-retardant evaluation was carried out. The results are shown in Table 3.

As shown in Table 3, flame retardance was good for Examples 7 and 8. On the other hand, since Comparative Examples 6 and 7 did not use knit fabric compared with Examples 7 and 8, the carbonized film was not able to absorb shrinkage of the fiber by heat and the film was broken, and the urethane foam was ignited.

What is claimed is:

1. A flame-retardant mattress comprising an internal structure covered with flame-retardant knit fabric that comprises at least two fibers selected from the group consisting of (A) a halogen-containing fiber, (B) a cellulosic fiber, (C) a flame-retardant cellulose fiber and (D) a polyester fiber, has a weight per unit area of at least 140 $g/m^2$ and a thickness of at least 0.5 mm and up to 1.4 mm, and contains a flame retardant at a ratio of at least 2% by weight based on the whole fabric, wherein the mattress can thus prevent fire spreading into internal structure in TB603 Flammability Test of State of California, United States, and wherein the knit fabric comprises the flame-retardant cellulosic fiber (C) which is a rayon fiber containing a flame retardant selected from silicic acid and aluminum silicate in an amount of 20 to 50% by weight.

2. The flame-retardant mattress according to claim 1, wherein the halogen-containing fiber (A) is modacrylic.

3. The flame-retardant mattress according to claim 1, wherein the cellulosic fiber (B) is at least one fiber selected from the group consisting of cotton, hemp, rayon, polynosic, cupra, acetate and triacetate.

4. The flame-retardant mattress according to claim 3, wherein the cellulosic fiber (B) is a cotton fiber.

5. The flame-retardant mattress according to claim 1, wherein the flame-retardant cellulosic fiber (C) is a fiber in which a flame retardant selected from the group consisting of phosphoric ester compounds, halogen-containing phosphoric ester compounds, condensed phosphoric ester compounds, polyphosphate compounds, red phosphorus, amine compounds, boric acid, halogen compounds, bromides, urea-formaldehyde compounds, phosphate-urea compounds and ammonium sulfate is added to the cellulosic fiber (B) in an amount of 6 to 25% by weight.

6. The flame-retardant mattress according to claim 1, wherein the knit fabric contains an Sb compound in an amount of 2 to 20% by weight.

7. The flame-retardant mattress according to claim 1, wherein the knit fabric comprises the halogen-containing fiber (A) and the cellulosic fiber (B).

8. The flame-retardant mattress according to claim 1, wherein the knit fabric comprises 20 to 65% by weight of the halogen-containing fiber (A), 35 to 80% by weight of the cellulosic fiber (B) and 0 to 30% by weight of the polyester fiber (D).

9. The flame-retardant mattress according to claim 1, wherein the knit fabric comprises the halogen-containing fiber (A) and the flame-retardant cellulosic fiber (C).

10. The flame-retardant mattress according to claim 9, wherein the knit fabric comprises 20 to 80% by weight of the halogen-containing fiber (A), 20 to 80% by weight of the flame-retardant cellulosic fiber (C) and 0 to 30% by weight of the polyester fiber (D).

11. The flame-retardant mattress according to claim 1, wherein the knit fabric comprises the cellulosic fiber (B) and the flame-retardant cellulosic fiber (C).

12. The flame-retardant mattress according to claim 11, wherein the knit fabric comprises 35 to 80% by weight of the cellulosic fiber (B), 20 to 65% by weight of the flame-retardant cellulosic fiber (C) and 0 to 30% by weight of the polyester fiber (D).

13. The flame-retardant mattress according to claim 1, wherein the internal structure of the mattress is covered with a flame-retardant knit fabric, and the outermost covering is a piled flame-retardant knit fabric.

14. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises 20 to 65% by weight of the halogen-containing fiber (A), 35 to 80% by weight of the cellulosic fiber (B) and 0 to 30% by weight of the polyester fiber (D).

15. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises 20 to 80% by weight of the halogen-containing fiber (A), 20 to 80% by weight of the flame-retardant cellulosic fiber (C) and 0 to 30% by weight of the polyester fiber (D).

16. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises 35 to 80% by weight of the cellulosic fiber (B), 20 to 65% by weight of the flame-retardant cellulosic fiber (C) and 0 to 30% by weight of the polyester fiber (D).

17. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, and wherein the knit fabric comprises 20 to 65% by weight of the halogen-containing fiber (A), 35 to 80% by weight of the cellulosic fiber (B) and 0 to 30% by weight of the polyester fiber (D).

18. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, and wherein the knit fabric comprises 35 to 80% by weight of the cellulosic fiber (B), 20 to 65% by weight of the flame-retardant cellulosic fiber (C) and 0 to 30% by weight of the polyester fiber (D).

19. The flame-retardant mattress according to claim 7, wherein the knit fabric further comprises the polyester fiber (D).

20. The flame-retardant mattress according to claim 9, wherein the knit fabric further comprises the polyester fiber (D).

21. The flame-retardant mattress according to claim 11, wherein the knit fabric further comprises the polyester fiber (D).

22. The A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises the halogen-containing fiber (A) the cellulosic fiber (B), and the polyester fiber (D).

23. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises the halogen-containing fiber (A), the flame-retardant cellulosic fiber (C), and the polyester fiber (D).

24. A flame-retardant mattress comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, wherein the knit fabric contains an Sb compound in an amount of 2 to 20% by weight, and wherein the knit fabric comprises the cellulosic fiber (B), the flame-retardant cellulosic fiber (C), and the polyester fiber (D).

25. The flame-retardant mattress according to claim 1, wherein the thickness is up to 0.8 mm.

26. A flame-retardant comprising an internal structure covered with a flame-retardant knit fabric that comprises at least two fibers selected from the group consisting of (A) a halogen-containing fiber, (B) a cellulosic fiber, (C) a flame-retardant cellulosic fiber and (D) a polyester fiber, has a weight per unit area of at least 140 g/m$^2$ and a thickness of at least 0.5 mm, and contains a flame retardant at a ratio of at least 2% by weight based on the whole fabric, wherein the mattress can thus prevent fire spreading into the internal structure in TB603 Flammability Test of State of California, United States, and wherein the knit fabric contains an Sb compound in an amount of 2 to 20% by weight, and the thickness is up to 0.8 mm.

27. The flame-retardant mattress according to claim 17, wherein the thickness is up to 1.4 mm.

28. The flame-retardant mattress according to claim 27, wherein the thickness is up to 0.8 mm.

29. The flame-retardant mattress according to claim 18, wherein the thickness is up to 0.8 mm.

* * * * *